US005661273A

United States Patent [19]

Bergiadis

[11] Patent Number: 5,661,273

[45] Date of Patent: Aug. 26, 1997

[54] SOUNDPROOF WALL

[76] Inventor: Bill Bergiadis, 25540 Avenue Stanford, Valencia, Calif. 91355

[21] Appl. No.: 473,349

[22] Filed: Jun. 7, 1995

[51] Int. Cl.[6] ..... E04B 1/82

[52] U.S. Cl. ..... 181/290; 181/285; 181/294; 52/145

[58] Field of Search ..... 181/210, 284, 181/285, 286, 287, 290, 294, 295; 52/144, 145

[56] References Cited

U.S. PATENT DOCUMENTS

| | | | |
|---|---|---|---|
| 2,177,393 | 10/1939 | Parkinson | 52/145 X |
| 4,130,175 | 12/1978 | Hehmann . | |
| 4,274,506 | 6/1981 | Blomgren et al. | 181/210 |
| 4,487,291 | 12/1984 | Walker . | |
| 4,607,466 | 8/1986 | Allred . | |
| 4,838,524 | 6/1989 | McKeown et al. . | |
| 4,842,097 | 6/1989 | Woodward et al. . | |
| 4,923,034 | 5/1990 | Okuzawa et al. . | |
| 5,153,388 | 10/1992 | Wittenmayer et al. . | |
| 5,186,996 | 2/1993 | Alts . | |
| 5,214,894 | 6/1993 | Glesser-Lott | 52/144 X |
| 5,246,760 | 9/1993 | Krickl . | |
| 5,268,540 | 12/1993 | Rex . | |
| 5,297,369 | 3/1994 | Dickinson | 52/145 X |

*Primary Examiner*—Khanh Dang
*Attorney, Agent, or Firm*—Oppenheimer Poms Smith

[57] ABSTRACT

A sound insulating barrier for improving acoustics in buildings, theaters, and around freeways, is disclosed. The sound insulating barrier has a multi-layer construction made of a layer of wood wool, a layer of basalt insulation material, a layer of sheet rock and a central core of basalt insulation material. These layers are repeated on the opposite side of the central core of basalt insulation to obtain a stand-alone wall. Alternatively, the layers up to the central basalt insulation layer can be attached to any pre-existing flat surface. The basalt insulation material is made of mineral wool. Conventional spacers can be used to separate layers or to improve the integrity of the wall. Furthermore, the sound insulating barrier can be built around conventional construction studs.

16 Claims, 2 Drawing Sheets

SOUNDPROOF WALL

BACKGROUND OF THE INVENTION

1. Field of the Invention

The present invention relates to soundproof walls. More precisely, the present invention relates to soundproof walls having multiple layer construction using basalt insulation.

2. Prior Art and Related Information

Sound absorption is fairly important in today's noisy society. In an environment that is growing in population density, noise pollution is a common problem. For example, sound transmission in a densely populated apartment complex, a busy freeway where traffic noise is high, or even a busy office with constant telephone rings or typewriter din exemplify environments where soundproofing and noise reduction are important.

Noise reduction technology is also important in certain acoustical environments such as in a concert hall, movie theater, or restaurant. It is desirable to have precise control of the acoustics so that patrons can fully enjoy their aural experience.

There have been various attempts at reducing noise and controlling sound. As seen in many movie theaters, sound engineers often cover all hard, reflective surfaces with cloth curtains, carpeting or other sound absorbent material. Moreover, by shaping the surface of the walls, it is possible to cause sound waves at given frequencies to cancel out thereby minimizing noise. This technology is well-known in the art.

There are several patents directed to a soundproof wall. For example, U.S. Pat. No. 4,838,524 to McKeown, et al., discloses a sound-proof wall comprising of a front corrugated, perforated sheet and a rear corrugated solid sheet which together define a chamber, with a central sinusoidally corrugate perforated sheet within the chamber. A blanket of noise-absorbing material is disposed over each side of the central sinusoidally corrugated perforated sheet.

U.S. Pat. No. 5,246,760 to Krickl discloses an insulating material for walls, ceilings, and roofs consisting of a sheep wool fleece sandwiched between two layers of needled non-woven material. Krickl also relies on mineral wool to be placed in the walls, ceilings, and roofs of buildings.

U.S. Pat. No. 4,923,034 to Okuzawa et al. discloses a vibration controlling member for use in a floor board and the like in a multi-stored apartment house or condominium. Okuzawa discloses multi-layered sheets having top and bottom plates sandwiching a foamed body sheet for shock absorption. The foam body sheet is formed by a polymeric material and includes, internally, a flake-shaped powdery substance. The top surface plate is formed from a wooden material or a polymeric material such as a synthetic resin; the bottom plate is formed from similar type material.

U.S. Pat. No. 4,842,097 to Woodward et al. discloses a sound-absorbing structure for a wall or ceiling having acoustic cavities behind the panels and slots in the panels for air flow. Some cavities are devoid of any insulation materials, and other cavities enclose at least some insulation material.

U.S. Pat. No. 4,607,466 to Allred discloses an acoustic panel having a porous layer and a generally rigid layer affixed to each other. The rigid layer includes at least one passage way opening on one side of the ridged layer and extends through the rigid layer through the porous layer. The passage way opening has dimensions set according to the Helmholtz resonance theory so that the panel vibrates thereby absorbing sound waves.

U.S. Pat. No. 4,487,291 to Walker discloses sound attenuation partitions for a building having a cavity between opposing panels which are enhanced by a bowed blanket of mineral fibers within the cavity.

There have been other attempts at noise absorption not necessarily relating to building construction. For example, U.S. Pat. No. 5,268,540 to Rex discloses a sound-absorbing noise barrier panel made from reinforced, pre-cast concrete panel skin formed with structural ribs extending therefrom at spaced intervals to provide structural strength to the panel and to form compartments throughout the panel. The compartments are filled with sound-absorbing materials and covered with a protective metal mesh which is, in turn, covered with decorative material which allows penetration of noise. There is also a second outer cover of fiberglass reinforced concrete lattice.

U.S. Pat. No. 5, 153,388 to Wittenmayer et al. describes a sound insulating arrangement for partition walls in motor vehicles. The sound insulating arrangement comprises a thin foam layer facing the sheet metal or other surface element, a heavy layer and an airborne sound absorber laminated or foamed thereon.

U.S. Pat. No. 5,187,996 to Alts describes a sound absorbing multi-layer structure made of a structural part that is capable of oscillating and a loosely-engaging damping sheet which sheet comprises a flexible material and high material absorption factor, and is made up of a heavy sheet with a visco-elastic support layer tightly connected thereto.

U.S. Pat. No. 4,130,175 to Hehmann discloses an acoustic suppression panel made from a perforated plate covering a layer of fibrous bulk absorber. A flexible, fluid-impervious membrane is placed between the perforated plate and the bulk absorber and is separated from the bulk absorber by spacers that permit the membrane to become essentially, acoustically transparent and to move or vibrate. The acoustic suppression panel is designed for use in an aircraft engine environment.

In view of the foregoing, there is a need for a multi-layered sound insulating barrier exploiting the benefits of a layer of basalt insulation.

SUMMARY OF THE INVENTION

The present invention is directed to a sound insulating barrier. More precisely, the present invention is an alternative to conventional building constructions that substantially reduces cost per square foot and overall construction time. Using advanced construction methods and materials, the present invention design for a sound insulating barrier surpasses conventional designs in sound proofing capability.

The present invention features many advantages. For example, building and related costs are reduced because the present invention has a very simple construction. When the present invention is integrated into the composition of a building shell, there is less construction, which in turn saves costs for concrete foundation. Furthermore, the present invention shell weighs less than conventional masonry shell, thereby reducing the strength requirements of the foundation and concurrently the costs of the foundation.

Because there are fewer combustible components due to use of basalt insulation of the present invention in a particular building, fire protection requirements are also satisfied. Use of the present invention in the roof insures the roof is leak-proof.

In one specific application, the present invention sound insulating barrier eliminates any screening room size limitations relating to positioning and placement of steel columns. In particular, the present invention sound insulating barrier can be a stand-alone wall, so there is no need for attachment to permanent support columns that rise up to the roof. Indeed, the present invention sound insulating barrier is optionally not part of the building structure, so the barriers may be moved or added at any time without major remodeling costs.

The present invention insulating barrier easily adapts to an array of exterior finishes. A building's exterior finish is no longer limited to traditional masonry block. For example, the present invention sound insulating barrier can be finished in brick, stone, stucco, or even wood siding.

The present invention has superior sound insulating characteristics. In a preferred embodiment, the present invention has an NRC rating of 95 minimum, and an STC rating of 58 minimum. The present invention further has a fire rating of three hours. These ratings are for a bare wall.

The superior acoustical performance of the present invention means that it is well suited for digital sound environments such as in a screening room, a multi-theater complex, a recording or rehearsal studio, and the like. In these places, the present invention totally eliminates sound transmission between adjacent rooms.

The present invention in an alternative embodiment can be applied to a pre-existing wall, concrete partition, or any similar flat surface. For example, the present invention can be used on a sound wall adjacent a freeway for reduction of traffic noise in a congested neighborhood.

To achieve the foregoing objects, the present invention relates to a sound insulating barrier comprising of a first layer of a sound attenuation batt, a first inner wall separated from the sound attenuation batt first layer by a spacer to form a first space therebetween. A second inner wall is separated from the first inner wall by a spacer to form a central space therebetween. A second layer of the sound attenuation batt is separated by a spacer from the second inner wall to form a second space therebetween so that at least one of the first space, second space and central space includes a dense sound attenuation batt.

In a preferred embodiment, the dense sound attenuation batt comprises a basalt insulation or mineral wool. In a preferred embodiment, the sound attenuation batt includes wood wool.

The present invention is therefore easily adapted to a variety of applications including building construction, freeway noise reduction, multi-theater sound control, restaurant noise suppression, and the like. The basalt insulation simplifies construction, is light-weight, and is also highly flame retardant.

The present invention can be used as a veneer to cover a pre-existing flat structure such as a sound wall adjacent a freeway. In such an alternative embodiment, the present invention sound insulating barrier comprises a layer of a sound attenuation batt, an inner wall separated from the sound attenuation batt layer by a first spacer to from a first space therebetween, a second spacer separating the inner wall from the flat structure to which the sound insulating barrier is attached to form a second space therebetween, and basalt insulation that is disposed in at least one of the first space or the second space.

BRIEF DESCRIPTION OF THE DRAWINGS

The objects, features, and advantages of the present invention will be apparent to one skilled in the art from reading the following detailed description in which.

DETAILED DESCRIPTION OF THE INVENTION

The following specification describes a sound insulating barrier. In the description, specific materials and configurations are set forth in order to provide a more complete understanding of the present invention. But it is understood by those skilled in the art that the present invention can be practiced without those specific details. In some instances, well-known elements are not described precisely so as not to obscure the invention.

The present invention is directed to a sound insulating barrier comprising a first layer of a sound attenuation batt, a first inner wall separated from the first layer by a spacer to form a first space therebetween, a second inner wall separated from the first inner wall by a spacer to form a central space therebetween, a second layer of the sound attenuation batt, separated by a spacer from the second inner wall to form a second space therebetween, wherein at least one of the first space, second space, and central space includes a dense sound attenuation batt. In the preferred embodiment, the dense sound attenuation batt is comprised of basalt insulation which can be a mineral wool. Furthermore, in the preferred embodiment of the present invention, the sound attenuation batt is comprised of a wood wool. Preferably, the first and the second inner walls are made of sheet rock such as that found in a dry wall used in home construction.

Figure 1:
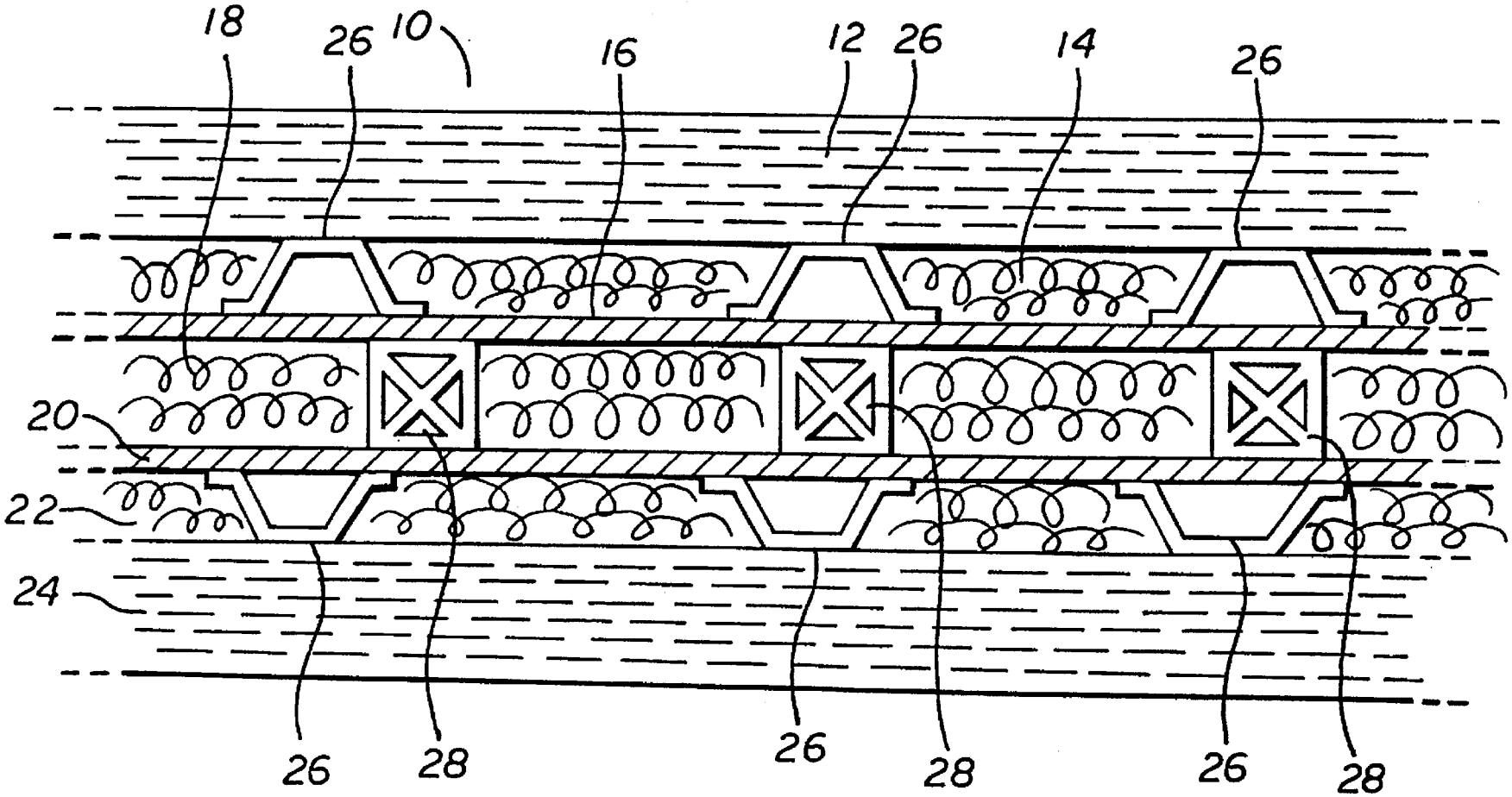
FIG. 1 is a side elevational, sectional view of a preferred embodiment of the present invention showing a multi-layered construction sound insulating barrier.

FIG. 1 is side elevational, sectional view of a preferred embodiment of the present invention showing a multi-layer construction sound insulating barrier. In the present invention sound insulating barrier 10, the layered construction basically comprises a basalt insulation or dense sound attenuation batt, and a sound absorption material, which are the major components.

The first layer of the sound insulating barrier 10 is a layer of wood wool 12 which acts as a sound absorption layer. The wood wool 12 is typically made from a fibrous plank material such as wood chips or fibers that are sprayed with calcium chloride and mixed with cement powder and pressed into sheets or batting. The first layer of wood wool 12 absorbs and breaks up a sound wave over its preferably two-inch thickness.

The next layer is preferably an inch and one-half thickness of dense basalt insulation material 14. This material is denser than fiberglass insulation and is therefore generally described as dense. Preferably, this basalt insulation material is a mineral wool that is non-combustible because it is made from a crystalline rock of volcanic origin. This layer further diminishes any sound waves passing through the layer of wood wool 12.

Any weakened sound wave which penetrates the basalt insulation layer 14 must next pass through a layer of sheet rock 16. The sheet rock is preferably ⅝ inch thick. The sheet rock 16 is basically made from a dry wall mud with an acrylic bonding agent so that the joints between the panels of drywall are sealed to minimize sound transmission.

If any sound wave passes through the sheet rock 16, the present invention includes an additional inner layer of basalt insulation 18. In the preferred embodiment, this inner layer is approximately 3½ inch thick.

The present invention sound insulation barrier in a preferred embodiment has a symmetrical construction so that the layers on opposite sides of the central basalt insulation layer 18 are identical. As seen in FIG. 1, there is another sheet rock layer 20, another dense basalt insulation layer 22 and another layer of wood wool 24.

In the preferred embodiment, spacers 26 are used to separate the wood wool layers 12, 24 from the inner walls of sheet rock 16, 20. The spacers 26 also help give some support to the wood wool 12, 24.

Conventional building construction studs 28 or similar type vertical members in a wall of a framed building are disposed between the sheet rock walls 16, 20 thereby spacing the two apart and providing space for the central dense basalt insulation layer 18. Thus, the present invention sound insulating barrier 10 is easily integrated into the building frame.

Figure 2:
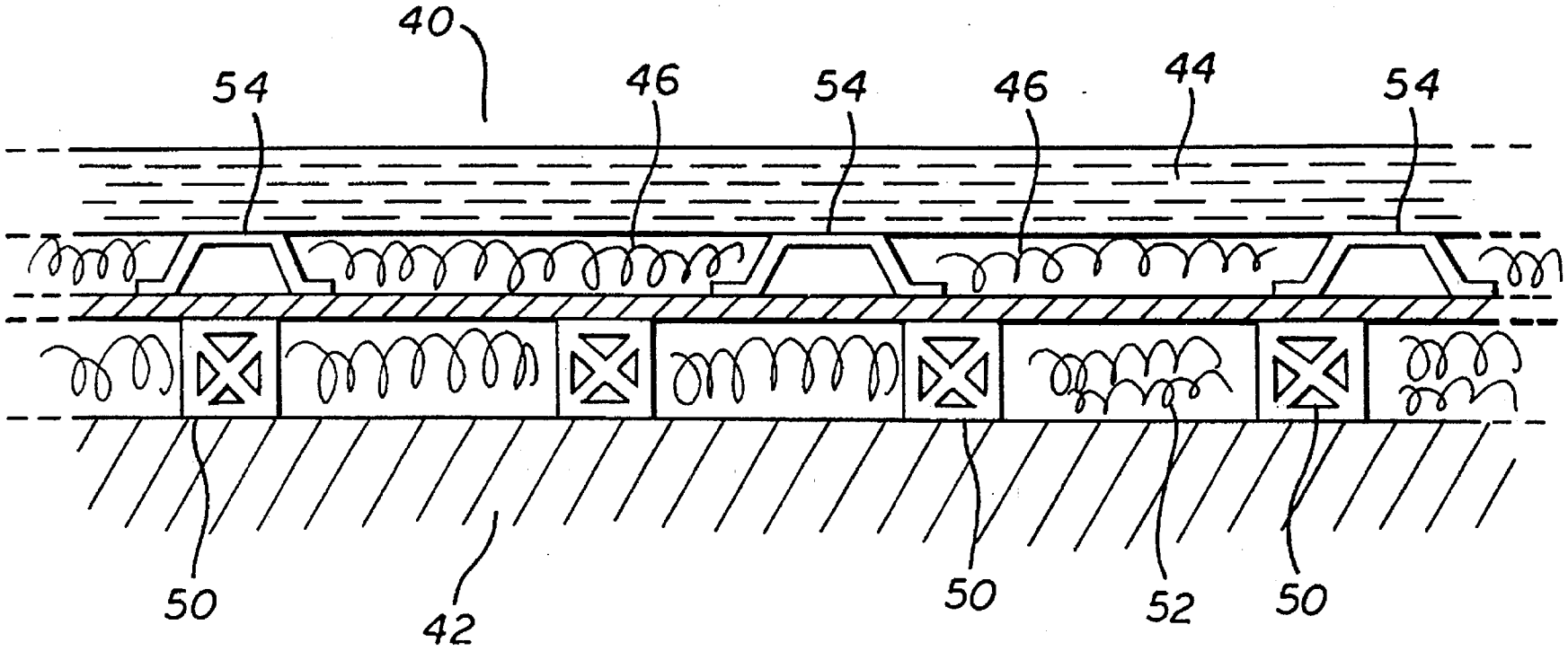
FIG. 2 is a side elevational, sectional view of an alternative embodiment of the present invention as attached to a flat surface.

The present invention can be made as a movable, standalone barrier integrated into the permanent frame of a building, or mounted to a pre-existing wall of a building or structure. As seen in FIG. 2, the present invention in an alternative embodiment provides a sound insulating barrier 40 that is built onto a flat surface 42. The flat surface 42 can be any part of a building where acoustics are important. It can be a freeway sound wall, an underground subway station wall, etc.

In the preferred embodiment shown in FIG. 2, the present invention sound insulating barrier 40 provides a layer of wood wool 44 used as a sound absorption layer. Directly beneath is a layer of dense basalt insulation material 46. Directly beneath the dense basalt insulation material 46 is a layer of sheet rock 48 supported on construction studs 50 or the like. Also beneath the sheet rock 48 is another layer of dense basalt insulation material 52. Again, conventional spacers 54 are used to help support the wood wool 44.

These sound insulating barrier 40 is attached to the construction studs through a variety of conventional means such as by bonding agents, staples, nails, or similar type fastening means known in the art.

To improve the appearance of the sound insulating barrier of the present invention, the wood wool shown in FIGS. 1 and 2 can be painted, or can be finished with brick, stone, stucco or even wood siding. Sound absorbing fabric can also be draped over the present invention sound insulating barrier to improve acoustics.

What is claimed is:

1. A sound insulating barrier comprising:

a first layer of sound attenuation batt;

a first, flat, continuous inner wall;

a first spacer separating the first layer from the first inner wall and forming a first space between the first layer and the first inner wall;

a second, flat, continuous inner wall;

a second spacer separating the second inner wall from the first inner wall and forming a central space between the second inner wall and the first inner wall;

a second layer of sound attenuation batt; and a third spacer separating the second layer from the second inner wall and forming a second space between the second layer and the second inner wall;

wherein at least one of the first space, second space, and central space contains sound attenuation batt.

2. The sound insulating barrier of claim 1, wherein the dense sound attenuation batt further comprises basalt insulation.

3. The sound insulating barrier of claim 1, wherein the first inner wall and the second inner wall each further comprises a drywall.

4. The sound insulating barrier of claim 1, wherein the sound attenuation batt further comprises a wood wool.

5. The sound insulating barrier of claim 1, wherein the dense sound attenuation batt includes a mineral wool.

6. The sound insulating barrier of claim 1, wherein the first layer and the second layer of the sound attenuation batt each comprise wood wool, and wherein the first space, second space, and central space each contain mineral wool.

7. A sound insulation barrier comprising:

two continuous sheets of flat, rigid material;

a first spacer separating the two rigid sheets and forming a central space between the two rigid sheets;

a first layer of sound attenuation batt disposed on an exterior side of each of the two rigid sheets;

a second spacer separating the first layer from the two rigid sheets and forming a first and second space;

a second layer of sound attenuation batt disposed within the first and second spaces, wherein the second layer has a higher density than the first layer and wherein the second layer extends continuously along the two continuous sheets.

8. The sound insulation barrier of claim 7, wherein each of the two rigid sheets further comprises sealed sheet rock.

9. The sound insulation barrier of claim 7, wherein the second layer of sound attenuation batt further comprises a basalt material.

10. The sound insulation barrier of claim 7, wherein the first means for spacing includes a corrugated spacer.

11. The sound insulation barrier of claim 7, wherein the second means for spacing further comprises a metallic stud.

12. A sound insulating barrier for a flat structure comprising:

a layer of a sound attenuation batt;

a continuous inner wall;

a first spacer separating the inner wall from the sound attenuation batt layer and forming a first space between the inner wall and the sound attenuation batt layer;

a second spacer separating the inner wall from the flat structure to form a second space between the inner wall from the flat structure; and basalt insulation disposed in at least one of the first space and the second space.

13. The sound insulating barrier of claim 12, wherein the layer of the sound attenuation batt includes wood wool.

14. The sound insulating barrier of claim 12, wherein the basalt insulation includes mineral wool.

15. The sound insulating barrier of claim 12, wherein the inner wall includes sheet rock.

16. The sound insulating barrier of claim 12, wherein the inner wall further comprises a sealed drywall.

* * * * *